United States Patent [19]

Lombard

[11] 4,192,223

[45] Mar. 11, 1980

[54] ADJUSTMENT DEVICE, NOTABLY FOR METERING RECIPROCATING PUMPS

[75] Inventor: Didier Lombard, Rouen, France

[73] Assignee: Dosapro Milton Roy, Pont-Saint-Pierre, France

[21] Appl. No.: 874,683

[22] Filed: Feb. 2, 1978

[30] Foreign Application Priority Data

Feb. 10, 1977 [FR] France ..... 77 03749

[51] Int. Cl.[2] ..... F01B 31/12; F15B 15/24; F16J 1/10

[52] U.S. Cl. ..... 92/5 R; 92/13; 92/94; 92/129; 92/165 PR; 91/DIG. 4; 92/99

[58] Field of Search ..... 92/23, 13.6, 13.8, 13, 92/129, 5 R, 165 PR, 94; 417/214

[56] References Cited

U.S. PATENT DOCUMENTS

| | | | |
|---|---|---|---|
| 1,771,907 | 7/1930 | Abramson | 92/129 |
| 1,856,599 | 5/1932 | Sundstrond | 92/13 |
| 2,323,950 | 7/1943 | Wade | 92/13 |
| 2,359,960 | 10/1944 | Anderson | 92/129 |
| 3,036,525 | 5/1962 | Schulze | 92/129 |
| 3,120,811 | 2/1964 | Jemison et al. | 92/13 |
| 3,164,024 | 1/1965 | Tarry et al. | 92/13 |
| 3,486,455 | 12/1969 | Jemison | 92/13 |
| 3,841,796 | 10/1974 | Schlonsky | 92/129 |

FOREIGN PATENT DOCUMENTS

| | | | |
|---|---|---|---|
| 152044 | 4/1932 | Switzerland | 92/13 |

*Primary Examiner*—Paul E. Maslousky
*Attorney, Agent, or Firm*—Wenderoth, Lind & Ponack

[57] ABSTRACT

In a reciprocating pump, notably a metering pump, of the reciprocating type in which the pumping member, diaphragm or piston, is actuated by means of a slide block responsive to a rotating eccentric member, a ball is interposed between an adjustment screw controlling the length of the slide block stroke and the slide block. For this purpose, the ball engages an inclined surface formed in a hollow of the slide block. Preferably, the screw is magnetized and constantly attracts the ball to avoid movements of the ball in relation to the slide block and therefore any premature wear and tear of these members. The inclined surface may have a shape matching that of the ball.

11 Claims, 4 Drawing Figures

Fig. 2
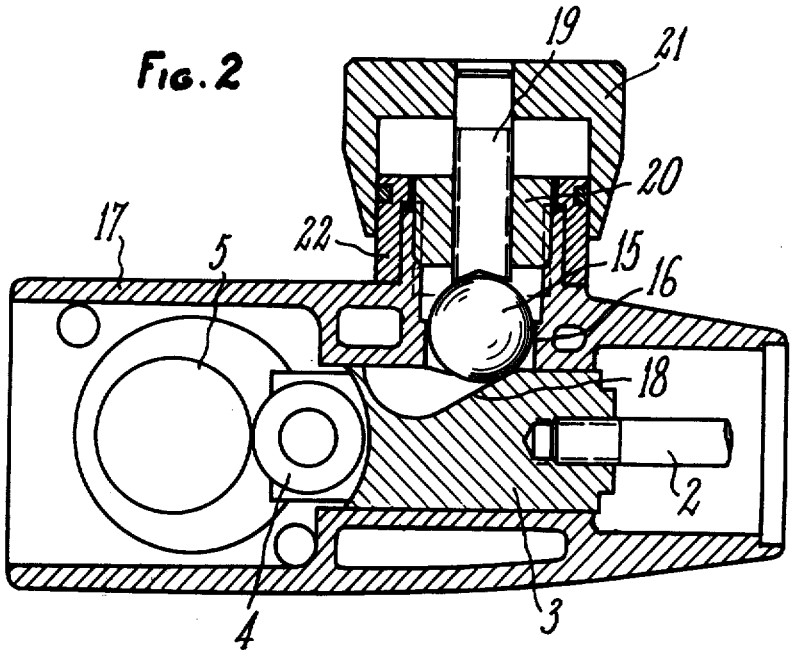
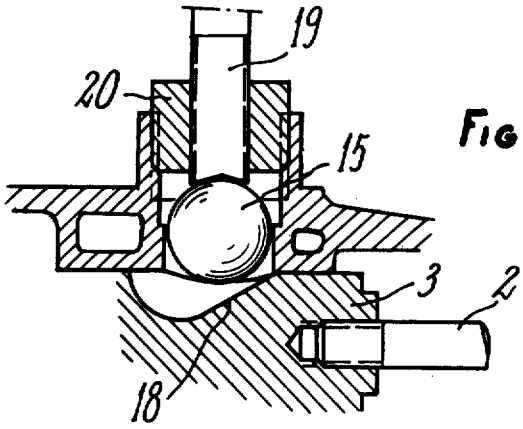
Fig. 3
Fig. 4
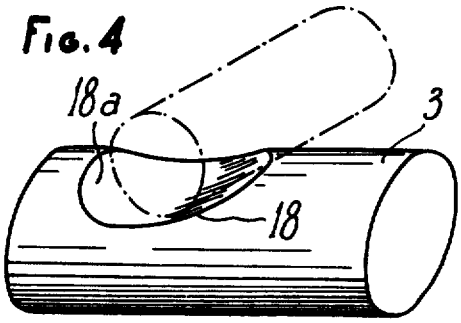

ADJUSTMENT DEVICE, NOTABLY FOR METERING RECIPROCATING PUMPS

BACKGROUND OF THE INVENTION

The present invention relates in general to reciprocating pumps, notably to low-power metering pumps.

DESCRIPTION OF THE PRIOR ART

In pumps of this character the reciprocating motion is obtained as a rule by means of an eccentric or cam member which, during its rotation, imparts a reciprocating motion to a slide block, this motion being transmitted to the member, diaphragm or piston, exerting the pumping function proper.

The stroke during which the slide block is moved away from the cam axis is in general the feed or power stroke of the pump piston. During this stroke the resistance to be overcome attains its highest value, since the stroke results from a direct pressure exerted by the cam on the slide block. The return or idle stroke, corresponding as a rule to the suction phase of the pump during which the efforts are relatively moderate and at any rate lower than the feed or power stroke, is produced by a spring holding the slide block in contact with the cam throughout this suction stroke.

In order to vary the pump output, certain reciprocating pumps and more particularly metering pumps, comprise in combination with the above-described mechanism means for adjusting the stroke of the pumping member, diaphragm or piston. In small pumps to which the present invention refers more particularly but not exclusively, the stroke is adjusted very simply by limiting the backward or return stroke of the slide block by means of abutment members. This method of adjusting the stroke by limiting the return or backward movement of the slide block is attended by a twofold advantage:

its construction is generally inexpensive;

the front dead center position is constant, irrespective of the stroke adjustment; this is particularly advantageous in reciprocating pumps, notably metering pumps, for the pump can be operated with the smallest possible dead space, thus improving priming capacities while reducing the risks of unpriming the pump due to the presence of gas in the pumped fluid.

U.S. Pat. No. 3,612,727 discloses an adjustable abutment system for the return or idle stroke of the slide block. It comprises a stud engaging the inclined face of a member disposed between the stud and the slide block actuating the pumping diaphragm. More particularly, this stud is enclosed in a case extending at right angles to the pump body and its position is adjustable in the case by means of a ball responsive to a set screw.

Although this arrangement is suitable for accurately adjusting the stroke of the slide block, it is attended by various inconveniences, of which the chief one is the rapid wear and tear characterising this system.

In fact, the abutment-forming stud engages with its tip the inclined face of the member interposed between the stud and the slide block, so that it operates in overhanging conditions, inasmuch as the adjustment implies that the stud protrudes more or less from its case. This overhang, combined with the repeated shocks that will necessarily occur when the stud engages the inclined face of the intermediate member, obviously tends to develop play between the stud and its supporting case, with the consequence that with time the precision of the pump adjustment will be impaired. If it is desired to limit this shortcoming, it is necessary to either restrict the capacity of the stroke adjustment system by limiting the same to extremely moderate efforts, or manufacture the adjustment components from sufficiently strong materials, thus increasing their cost. Moreover, the contact between the stud and the inclined face of the intermediate member is nearly punctual, or at the best linear, according to the length of the end bevel formed on the stud. This punctual contact is most likely to damage by hammering either the surface of the intermediate member, or the surface of the stud proper, thus definitely impairing the precision and sensitivity of the desired adjustment.

SUMMARY OF THE INVENTION

The present invention provides an improved stroke adjustment device for reciprocating pumps notably for low-power metering pumps, which combines the main advantages of known devices and avoids their inconveniences.

The adjustment device according to this invention is characterized essentially in that it comprises a ball disposed in a guide bore and adapted to be wedged therein during the return movement of the slide block, between an adjustable abutment member and a cam face formed on the slide block.

The various features and advantages characterizing this invention will appear more clearly as the following description of some of the preferred embodiments of the invention proceeds with reference to the accompanying drawings. However, it will readily occur to those conversant with the art that these embodiments are given by way of example only, not of limitation, since many modifications and changes may be brought thereto without departing from the basic principles of the invention as set forth in the appended claims.

BRIEF DESCRIPTION OF THE DRAWINGS

FIGS. 2 and 3 are sectional views showing details, on a larger scale, of the device of FIG. 1, and FIG. 4 is a fragmentary perspective view showing the slide block with its adjustment-ball wedging face.

DESCRIPTION OF THE PREFERRED EMBODIMENTS

Figure 1:
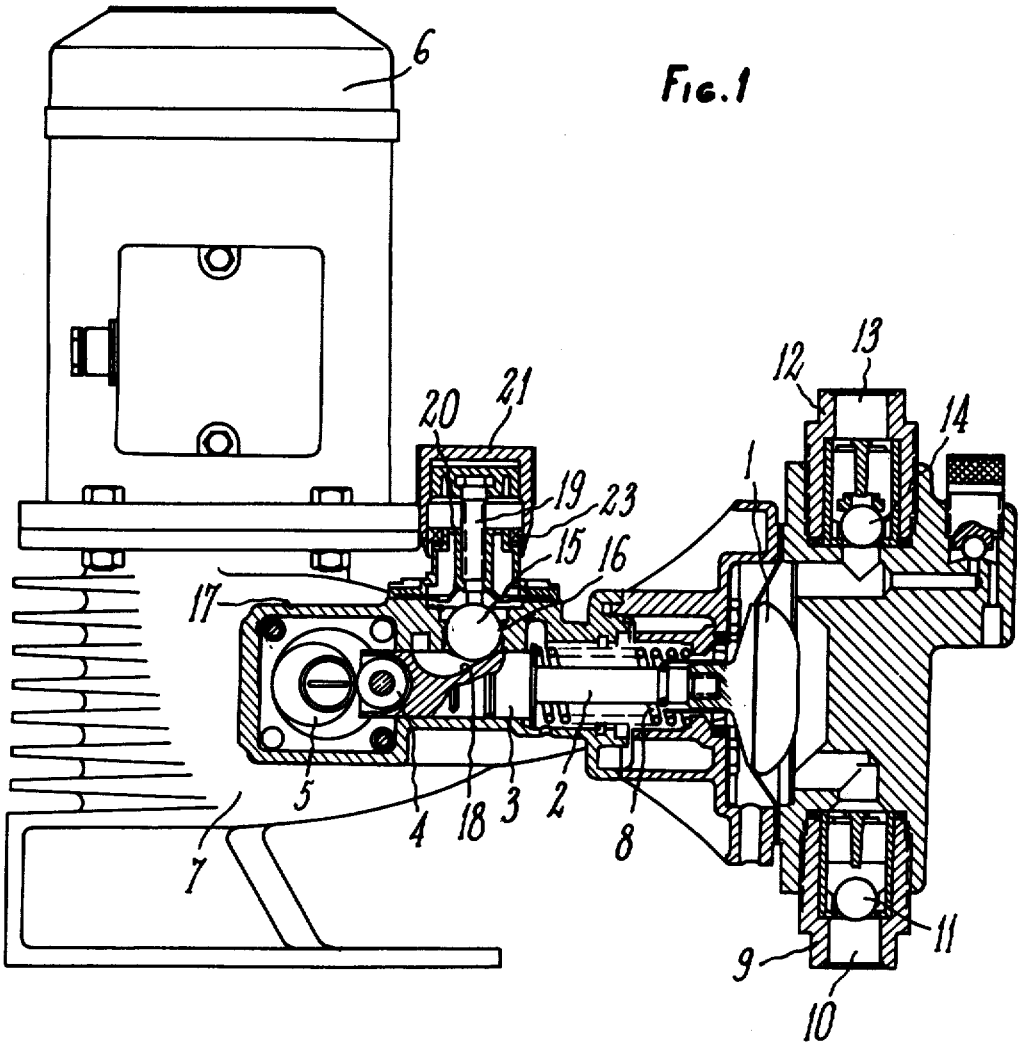
FIG. 1 is a part-sectional, part-elevational view of a diaphragm metering pump equipped with a first version of the adjustment device according to this invention.

The example illustrated and described herein is applied to a metering pump of known type wherein the pumping diaphragm 1 is responsive to a rod 2 rigid with a slide block 3 actuated through the medium of a roller 4 by an eccentric 5 rotatably driven by a motor 6 via a reduction gear (not shown) housed in a case 7. The slide block 3 is constantly urged towards the eccentric 5 by a return spring 8.

During the operation of the above-described actuating means the pumping diaphragm will alternatively suck in and force out the fluid flowing through the pump, namely, the fluid is sucked in through a first ball valve socket 9 comprising an inlet 10 and containing a ball 11, and forced out through another ball valve socket 12 comprising an outlet 13 and a ball 14.

The above arrangement is well known in the art and cited herein only for the sake of reference.

According to this invention, the return stroke of the slide block is adjusted by means of a ball 15 fitted in a bore 16 formed in the pump body 17. This ball 15 engages on the one hand an inclined face 18 formed in the slide block 3 and on the other hand an adjustment bolt or screw 19 engaging a nut 20. This screw 19 is adapted to be turned in either direction by means of a knurled knob 21 associated with a vernier 22 (see FIG. 2) fitted on a suitable boss of the body 17. The necessary fluid-tightness is obtained by means of a seal 23 which at the same time provides the friction necessary to keep the device in the selected adjustment position.

During the return stroke of slide block 3, its inclined face 18 stikes the ball 15 and the latter will thus act as an abutment member.

The cam face 18 has a predetermined inclination with respect to the axis of the slide block and its purpose is to cause a given angular adjustment of screw 19 (and therefore a given number of revolutions of the screw 19 and its adjustment knob 21) to correspond to a predetermined stroke of the slide block 3. Under these conditions, it is clear that during the power stroke of the slide block the latter moves away from the ball 15 toward which it will return during the suction or backward stroke. The abutment effort, during this return movement, is absorbed partly by the adjustment screw 19 and partly by the pump body 17.

This arrangement is attended by the following advantages.

Firstly, it will be seen from the onset that the stroke adjustment device according to this invention is capable of absorbing without any detrimental consequences the resistance efforts since none of its component elements is flexion-stressed, all the stresses produced during the pump operation being compressive stresses.

When necessary, the stroke may be adjusted by rotating the knob 21 through several turns, this only requiring a proper choice of the pitch of the threads of screw 19 and nut 20.

In general, this device is of course non-reversible. Moreover, the seal 23 prevents any untimely rotation of the knob 21. To palliate the natural wear of the body 17 of the adjustment mechanism as a consequence of the ball movements and of the friction resulting therefrom, the body of the adjustment mechanism may be lined either with a suitable wear-resistant material or with a wear-out member to be replaced when worn by the ball.

As a substitute for these convenient but expensive solutions, one may according to the invention and to a specific feature thereof utilize a screw 19 of magnetized material.

FIG. 3 illustrates on a larger scale one portion of FIG. 2 incorporating this improvement. In this Figure, the slide block 3 is in a position more advanced than the one in which it is shown in FIG. 2, so that the inclined face 18 of slide block 3 is no longer in contact with ball 15. Under normal conditions, this ball 15 would remain in engagement with the slide block 3 by moving inwardly, thus discontinuing its contact with the adjustment screw 19, but this ball 15 is still in contact with the screw because the latter consists of magnetized material and in this case the ball, such as a ball-bearing ball, which consists of magnetic steel, remains in contact with this adjustment screw. This ball-type stroke adjustment device utilizing a magnetic adjustment screw according to this invention will safely avoid any premature wear and tear of the ball with respect to the body 17 of the mechanism, and consequently any friction wear. This magnetization can be obtained very easily at a negligible cost and will eliminate friction wear completely.

Moreover, it is also advantageous to prevent the surfaces in mutual contact from being damaged by hammering, the latter being most likely to take place between the ball 15 and the screw 19, between the ball 15 and the body 17 of the mechanism, and also between the ball 15 and the slide block 3.

Before describing in detail each one of these hammering actions, it will be understood that they depend essentially on the stress and the impact speed. The stress caused by a spring in the type of pump to which the present invention is applicable more particularly is generally relatively moderate, and may vary between 5 and 50 kgf, the most probable value being of the order of 20 kgf. However and therefore, this is not very important. The pressures developing during the impact are subordinate to the velocity of slide block 3 at the time the shock takes place. In general the pump beats at the rate of about 120 strokes per/minute, corresponding to one to-and-fro movement every half-second. If we consider a stroke of, say, 10.4 mm, the maximum velocity of the slide block when the impact occurs will be 65 mm/s; now these values are extremely low and significant tests proved that the wear caused by such hammering were in most cases non-existant.

However, it may be advantageous to take the following precautions.

To increase the resistance to hammering between the ball and screw, it is suggested to give an enveloping configuration to the ball-contacting screw end.

To increase the resistance to hammering between the ball and the body 17 of the pump adjustment mechanism, it is advisable to make this body from the hardest possible material, at least as consistent with an economical manufacture, and to keep the play between these two members at its lowest possible value.

To avoid any detrimental hammering between the ball and the slide block, a practical solution consists in utilizing a metal treated to impart a sufficient hardness thereto, but this is not always consistent with an economical manufacture which may lead notably to the use of plastic materials.

According to this invention, it is preferable to increase the contact surface area between the ball and the slide block by forming on the latter a cam face consisting not of a flat surface but having, as illustrated in FIG. 4, the shape of a concave portion of a cylinder of a diameter matching the ball diameter. In this case, a linear contact is substituted for the punctual contact between the ball and the inclined face, hence a lower hammering stress per surface unit. The slide block may be made from a less resistant material, possibly plastic material.

The opposite portion of the notch formed in the slide block as a result of the cutting of the inclined face, of which the shape is immaterial or only of secondary importance, should only be such as to enable the ball 15 to utilize the maximum length of inclined face 18 without contacting the slide block at another point. This inoperative portion may have a rounded, concave shape, as shown for example in FIG. 4 which, in the embodiment contemplated herein, corresponds to the specific case of a slide block made from a mouldable material.

In comparison with the system known through the U.S. Pat. No. 3,612,727, the ball type stroke adjustment device according to the instant invention is characterized by the following advantageous features.

The manufacturing cost is considerably lower, since the ball may be an inexpensive standard ball-bearing ball. The bore in which this ball is guided has a relatively large diameter and a short length, so that it can be machined or otherwise obtained very easily and at a low cost. The screw is particularly cheap to manufacture since it may even be a standard screw or cut from standard threaded-rod stock. The nut shape is extremely simple. Regarding the keeping of the nut in the stroke adjustment position, it is obtained by using an elastomer seal ensuring the screw irreversibility. The resistance to wear and the load capacity may be extremely high. In fact, the device operates without any overhang and the stresses are absorbed by the screw only in the axial direction, which is the best possible mode of operation for a screw. The only points of wear may be the points of contact between the ball and the slide block, or between the ball and the body of the adjustment mechanism. The easy method of reducing this wear, on the one hand by increasing the surfaces in mutual contact by forming an enveloping impression, on the other hand by avoiding the to-and-fro movement of the ball by magnetizing the screw, has been clearly set forth in the foregoing. Furthermore, it may be noted that the wear caused by the movements of the ball in its bore is relatively moderate since no stress is applied to the ball during these movements. It may also be emphasized that the ball may consist of metal hardened by means of a suitable economical treatment (ball-bearing ball).

Of course, this invention should by no means be construed as being limited by the specific embodiments described and illustrated herein by way of example, since the invention is applicable to other types of pumps with similar results.

What is claimed as new is:

1. A reciprocating diaphragm pump comprising:

a pump casing;

a diaphragm pumping member positioned within said casing;

a slide block having a first end connected to said diaphragm pumping member and a second end, said slide block being mounted within said casing for axial reciprocal sliding movement therein;

means, operatively associated with said slide block adjacent said second end thereof, for intermittently moving said slide block in a first axial direction;

spring means for constantly urging said slide block in an opposite second axial direction toward said moving means;

said slide block having in a side surface thereof a groove at least partially defined by a surface which is inclined with respect to the direction of axial movement of said slide block;

a bore extending through said casing in a direction substantially transverse to said direction of axial movement of said slide block, said bore communicating with said groove in said slide block;

a ball supported within said bore and having a portion extending into said groove, such that said inclined surface of said groove abuts with said ball during movement of said slide block in said second axial direction, thereby limiting the extent of movement of said slide block in said second axial direction; and adjustment means, axially adjustably extending into said bore in a direction transverse to said direction of axial movement of said slide block and having an inner end abutting said ball, for adjusting the extent of said portion of said ball which extends into said groove, for thereby adjusting the relative position of said ball with respect to said inclined surface, and for thereby adjusting the extent of movement of said slide block in said second axial direction.

2. A pump as claimed in claim 1, wherein said adjustment means comprises a nut fixed to said casing, and a screw threadably engaged with and extending through said nut into said bore and in contact with said ball.

3. A pump as claimed in claim 2, wherein said screw is adapted to be actuated by means of a control knob associated with a vernier fitted on a boss of said casing.

4. A pump as claimed in claim 3, further comprising seal means for ensuring fluid-tightness of the device and locking said control knob, said seal means being disposed between said control knob and said vernier.

5. A pump as claimed in claim 3, wherein said inclined surface formed in said slide block is set at an angle selected to cause a given stroke of said screw and a predetermined rotation of said control knob to correspond to a predetermined stroke of said slide block.

6. A pump as claimed in claim 2, wherein said screw consists of magnetized material and said ball consists of magnetic material, whereby said ball is maintained in constant contact with said screw, thereby precluding movement between said ball and said bore, and thus avoiding wear therebetween.

7. A pump as claimed in claim 1, wherein contact surfaces between said ball and said slide block are shaped so that a linear contact therebetween is obtained, to thereby avoid premature wear and tear of said surfaces.

8. A pump as claimed in claim 1, wherein said inclined surface includes a portion having the shape of a portion of a cylinder having a diameter corresponding to that of said ball.

9. A pump as claimed in claim 1, wherein said moving means comprises a roller positioned to contact said second end of said slide block, an eccentric device having an eccentric cam surface in contact with said roller, and means for rotating said eccentric device.

10. A pump as claimed in claim 1, wherein said spring means comprises a coil spring within said casing and abutting said casing and said slide block.

11. A pump as claimed in claim 1, wherein said slide block is non-rotatably positioned within said casing.

* * * * *